US010625313B2

(12) United States Patent
Baugh

(10) Patent No.: US 10,625,313 B2
(45) Date of Patent: Apr. 21, 2020

(54) METHOD OF RELEASING A PIG AFTER PIPELINE REMEDIATION

(71) Applicant: Benton Frederick Baugh, Houston, TX (US)

(72) Inventor: Benton Frederick Baugh, Houston, TX (US)

( * ) Notice: Subject to any disclaimer, the term of this patent is extended or adjusted under 35 U.S.C. 154(b) by 116 days.

(21) Appl. No.: 15/625,153

(22) Filed: Jun. 16, 2017

(65) Prior Publication Data

US 2018/0361440 A1 Dec. 20, 2018

(51) Int. Cl.
*B08B 9/053* (2006.01)
*B08B 9/055* (2006.01)

(52) U.S. Cl.
CPC ..... *B08B 9/0558* (2013.01); *B08B 9/0535* (2013.01)

(58) Field of Classification Search
None
See application file for complete search history.

(56) References Cited

U.S. PATENT DOCUMENTS

| | | | |
|---|---|---|---|
| 6,122,791 | A | 9/2000 | Baugh |
| 6,651,744 | B1 | 11/2003 | Crawford |
| 7,025,142 | B2 | 4/2006 | Crawford |
| 7,998,276 | B1 | 8/2011 | Baugh |

*Primary Examiner* — Eric W Golightly

(57) ABSTRACT

The method of using the flow of liquid or gas in a pipeline to facilitate service operations within said pipeline by connecting to a service pig with a restraining line, deploying said service pig in said pipeline at a deployment location, holding back on the restraining line to cause a pressure differential buildup across the service pig to facilitate said service operations, releasing said service pig from the restraints the operations can be completed without bringing the service pig back to said deployment location.

9 Claims, 7 Drawing Sheets

METHOD OF RELEASING A PIG AFTER PIPELINE REMEDIATION

TECHNICAL FIELD

This invention relates to the method of cleaning a pipeline by using flow within the pipeline against a cleaning pig which is restrained by a line to provide a jetting differential across the cleaning pig and the causing the cleaning pig to be released from the restraint.

BACKGROUND OF THE INVENTION

The field of this invention is that of tools and methods used for the cleaning of pipelines, especially the long, extended reach pipelines in offshore areas. As hot production crude is produced from the reservoirs below the ocean floor up to the wellhead equipment at the ocean floor and then through pipelines along the ocean floor, it is cooled by the relatively cool temperature of the ocean water. In deep water, the temperature can be a cold as 34 degrees Fahrenheit.

A characteristic common to a majority of the oil produced is that there is a paraffin component to the oil which will deposit on the walls of the pipeline and become a solid at temperatures well above the 34 degrees Fahrenheit. In fact, some of the paraffins become solid at temperatures above 70 degrees Fahrenheit, and so can be deposited or plated on the internal diameters of the pipelines at any expected ambient temperature. The process is similar to discussions of blocking of the arteries of a human being, with a thicker coating building up with time. Some of the pipelines have become so plugged that more than 90% of the flow area is blocked with waxes or paraffins. In addition to slowing production, the coatings are a hazard as they can frequently lead to complete blockages of flow in the pipelines.

Typically, the wall becomes layered with paraffin as the temperature of the oil goes below the solidification temperature of the paraffins in the produced fluids. The paraffins act as a sort of insulation to the flowing fluids in the pipeline, allowing it to maintain a higher temperature for a greater distance. The effect of this is to extend the distance along the pipeline which the paraffin is plating onto the internal diameter of the pipeline.

A common cure for the paraffin plating out on the internal diameter of the pipeline is to insert a pig into the flow stream and let the pig remove some of the paraffin. A pig is typically a cylindrical or spherical tool which will brush against the internal diameter of the pipeline in hopes of removing the deposited paraffins. In pipelines with a high incidence of deposited paraffins, a regular maintenance of pigs is normally prescribed as a preventative against pipeline blockages.

One problem with the pigs is that the deposited paraffins are relatively soft and contain a lot of oil. To some extent, the pigs actually compress the paraffins against the wall and squeeze the oil out without removing the paraffins, leaving a harder and stronger paraffin remaining.

A second problem is that when the paraffin layer on the internal diameter of the pipe is too thick, sloughing off may occur. If the paraffin starts to separate from the wall and continues, the pig begins to literally plow a block of paraffin ahead of itself. The pig will continue driving more and more paraffin off the wall of the pipeline until the pressure of the pipeline will no longer be able to move the mass. At that time, you have a full pipeline blockage, which cannot be moved by pressure from either end.

At that time, the plug of paraffin must be removed by chemicals. Characteristically, the way chemicals are deployed to the location of the blockage is to use a string of coiled pipe or coiled tubing which is unreeled into the pipeline to provide a circulation path for the circulation of chemicals. As the end of the coiled pipe reaches the location of the blockage, the chemicals are circulated either out the coiled tubing and back through the annulus outside of the coiled tubing and inside the pipeline, or the flow will be in the opposite direction.

Before the pipelines are completely blocked, wire rope pigs such as are described in U.S. Pat. No. 7,998,276 offer and improved means for removing the paraffins plated onto the inner walls of the pipelines by restraining the movement of the pig with a wire rope and allowing a differential to be built up across the pig to provide a jetting pressure. The jetting pressure can compliment or substitute for the chemicals for improved cleaning. The wire rope pig provides and internal valve which allows the flow through the pig to be bypassed through a vent to allow the pig to be pulled back without pulling all the pipeline fluids back with it.

All the methods described have required the stopping of the revenue producing production and allowing pumps to take over the control process. In addition to the loss of production, the pumps are expensive to rent and expensive to mobilize to the jobsite, especially when offshore.

A need has long existed for a method of remediating the wax or paraffin buildup using jetting pressure without the use of expensive chemicals, and now shutting the expensive production flow down to accomplish it.

BRIEF SUMMARY OF THE INVENTION

The object of this invention is to provide a method of jet cleaning pipeline using flow in the pipelines without having to recover the cleaning pig back to the point of entry into the pipeline.

A second object of this invention is to provide a method of jet cleaning pipeline using flow in the pipelines.

A third objective of this invention is to provide a method of cleaning pipelines without the need of expensive chemicals.

Another objective of this invention is to provide a method of cleaning pipelines without needing special pumps.

DETAILED DESCRIPTION OF THE INVENTION

Figure 1:
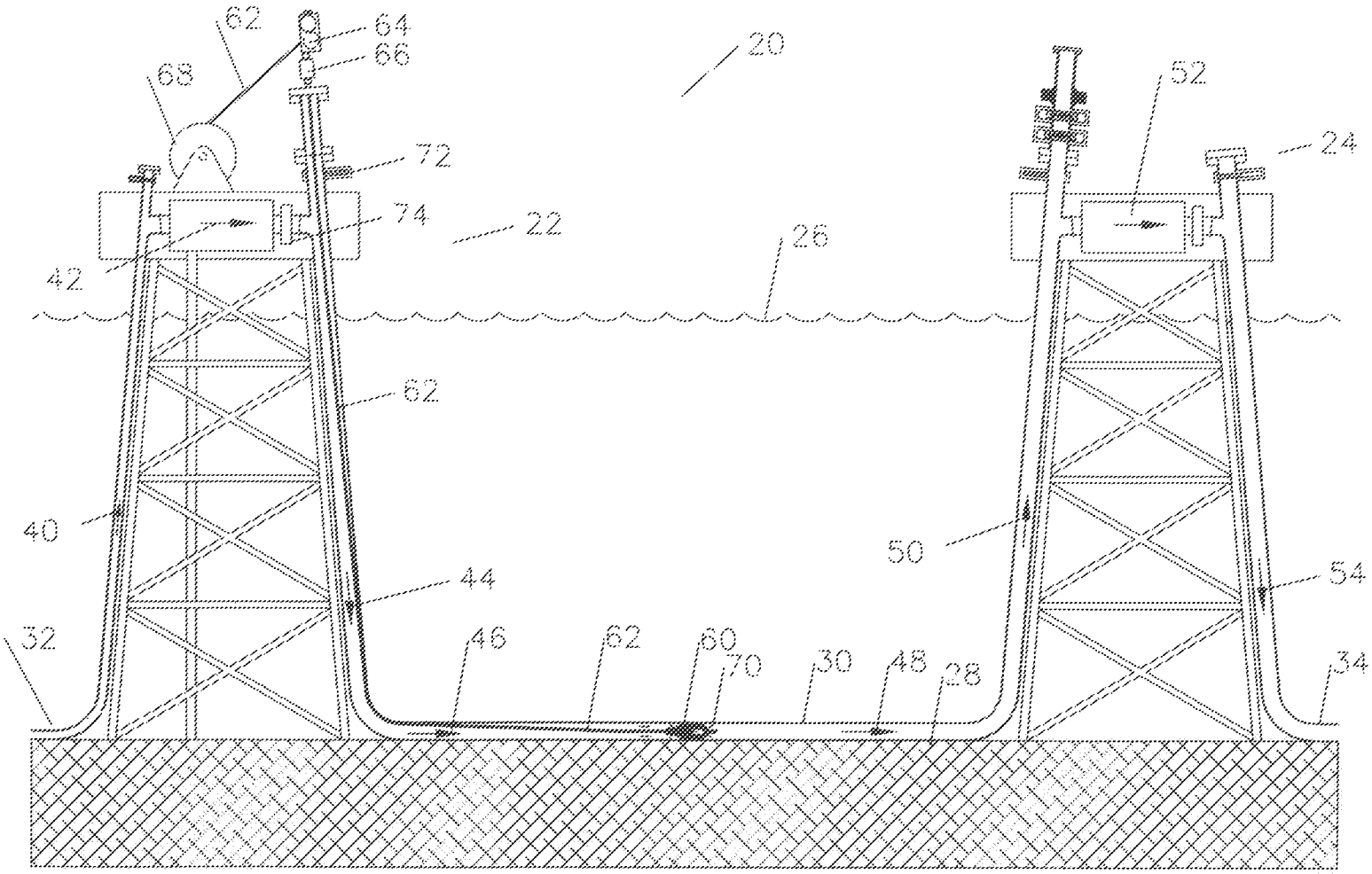
FIG. 1 is a half section of a system of subsea platforms that utilize the features of this invention showing a pig restrained at some point in a pipeline and cleaning the pipeline.

Referring now to FIG. 1, a view of a system 20 utilizing the present invention is shown with a first platform 22, a second platform 24, the ocean surface 26, the seafloor 28, a seafloor pipeline 30 connecting first platform 22 to second platform 24, an incoming pipeline 32 which brings hydrocarbons to first platform 22 and an export pipeline 34 which takes the hydrocarbons to a delivery point which is likely the shore.

Arrows 40-54 indicate the flow and direction of the flow within the pipelines. Cleaning pig 60 moves within the flow and is restrained from moving freely in the flow by restraining line 62 which may be a wire, a cable, a synthetic rope or the like. Restraining line 62 goes back to winch 64 with stripper 66 and storage reel 68 which provides the resisting force and controls the speed of the cleaning pig 60. As can be seen in U.S. Pat. No. 7,988,296, at least a portion of the flow can be directed thru jet nozzles aimed at the inner wall of the pipeline to utilize the existing flow of the pipeline to clean the inner wall of the pipeline as seen in arrows 70.

Alternately, the flow in the pipeline can be temporarily stopped by shutting valve 72 which allows the pig as described in U.S. Pat. No. 7,988,296 to switch to a mode where the flow is directed through a large vent port. At this point the pig can be simply pulled back using restraining line 62. If the vent port is large enough for the flow in the pipeline, the valve 72 can be immediately opened and production resumed as the cleaning pig is retrieved.

In using this method, the need to use chemicals is eliminated as the jetting is available to all parts of the pipeline. Further, as you are using the existing flow in the pipelines to move the pig and provide the jetting, the need for acquiring, delivering and using special pumps and pumping fluids is eliminated.

Figure 2:
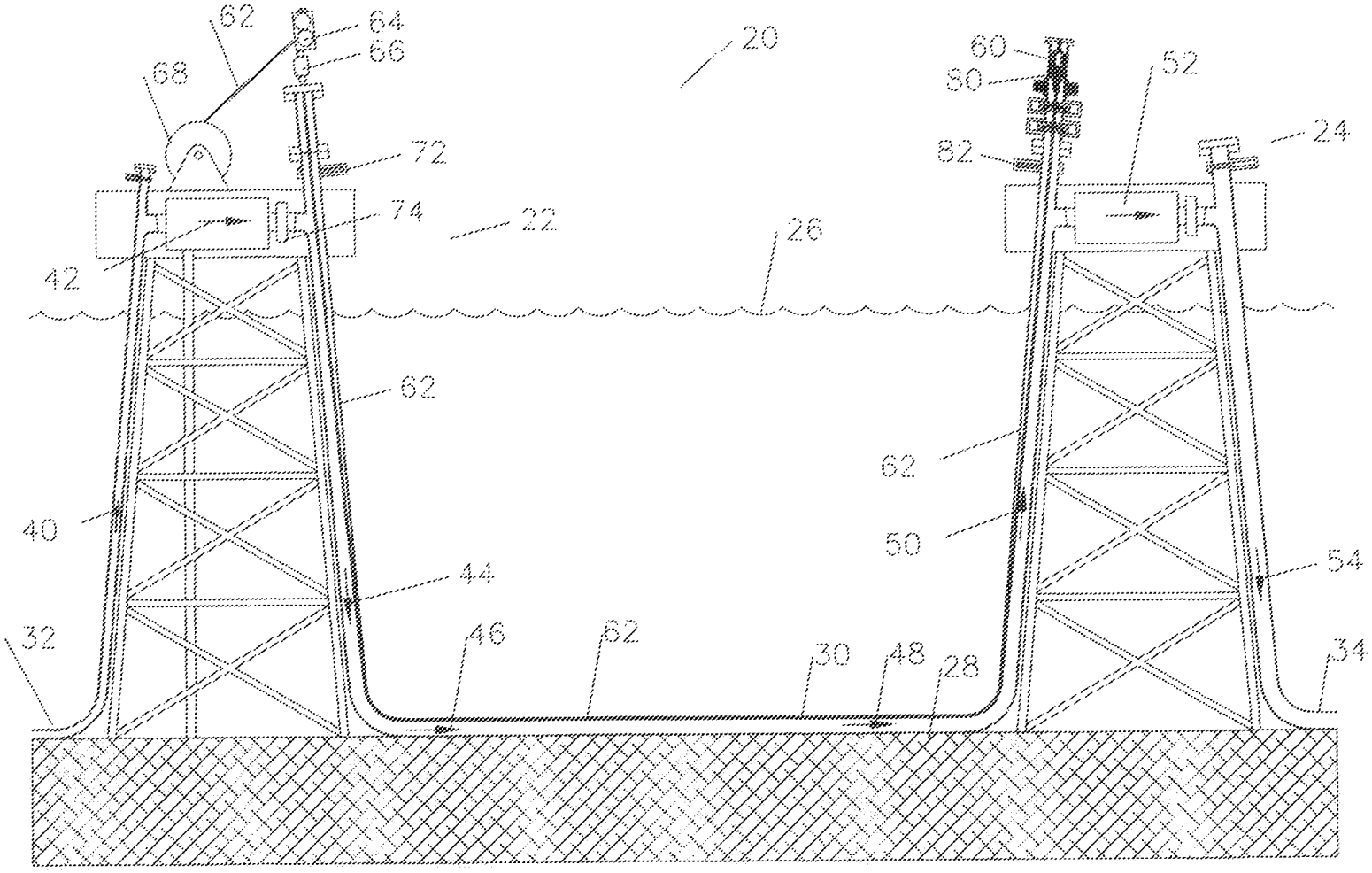
FIG. 2 is the half section of FIG. 1 showing the rest restrained pig reaching a destination point, in this case at a second platform.

Referring now to FIG. 2, cleaning pig 60 has travelled all the way to platform 24 and is stopped in pig catcher 80. Valve 82 has been opened to allow the cleaning pig 62 to enter the pig catcher 80.

Figure 3:
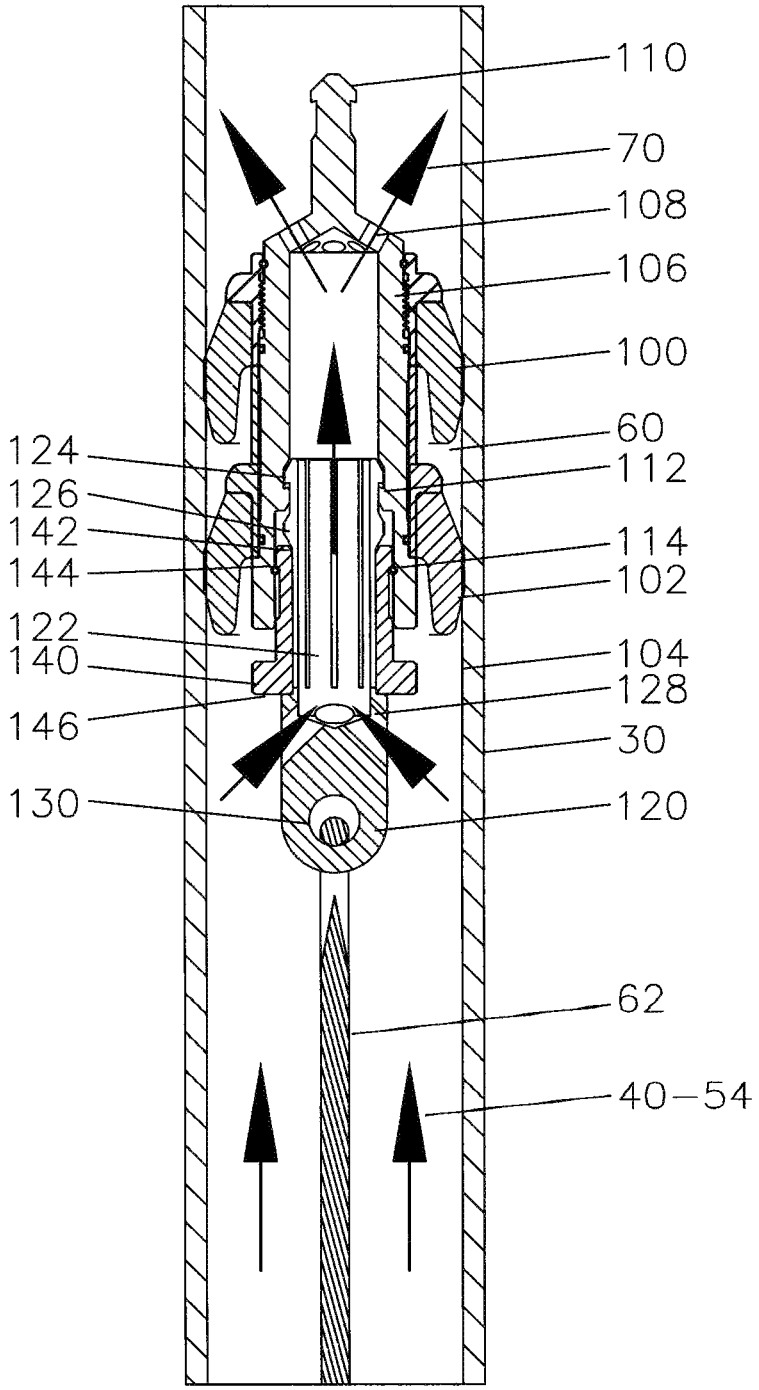
FIG. 3 is a half section of a pig showing it being restrained and accelerating the pipeline flow for jetting operations.

Referring now to FIG. 3, cleaning pig 60 is shown with sealing cups 100 and 102 sealingly engaging the internal surface 104 of pipeline 30. Cleaning pig body 106 provides jetting ports 108, a fishing neck 110 at the front, an internal locking groove 112 and a restraint pin 114. Collet 120 provides collapsible collet fingers 122 having locking shoulders 124 and collapsing ring 126, rear ports 128, and padeye hole 130. Release sleeve 140 provides release taper 142, restraint shoulder 144 which engages restraint pin 114, and stop shoulder 146.

Figure 4:
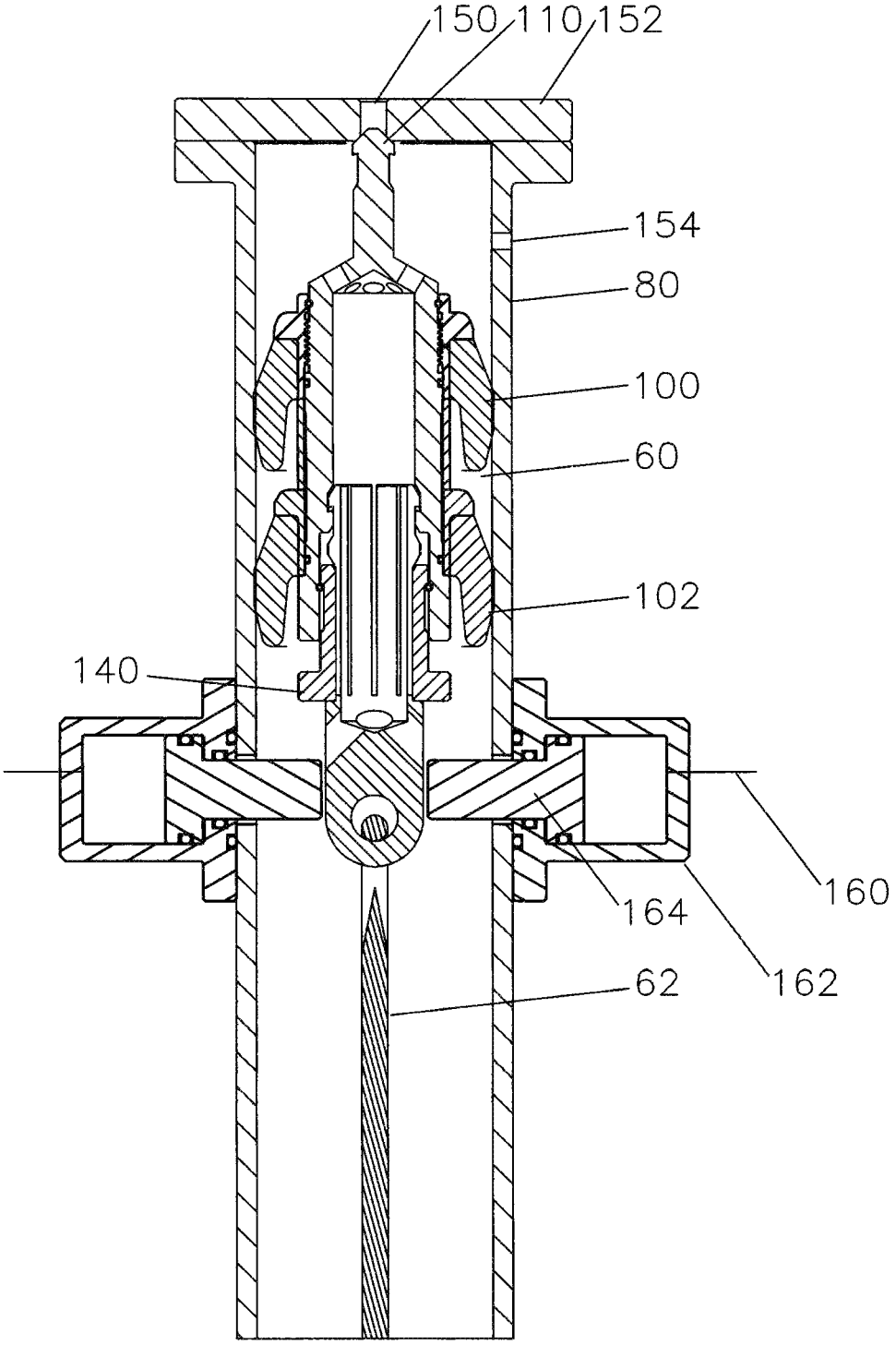
FIG. 4 is a half section of a pig showing it reaching a destination point and having release means inserted into the bore behind it.

Referring now to FIG. 4, cleaning pig 60 has entered the pig catcher 80 on platform 24 and fishing neck 110 has engaged port 150. Personnel or systems on platform 24 can be bleeding flow from port 150, and when this flow is stopped, it will provide a positive indication that the cleaning pig 60 has travelled the full distance to platform 24. Port 150 is shown concentric to cleaning pig 60 at the end of the pipeline, but other styles are as workable. One example is that there be no hole in flange 152 but rather a port such as 154 exists. When the fishing neck 110 on cleaning pig 60 engages flange 152, flow can be taken out of port 154. As the sealing cups 100 and 102 sealingly engage the bore of the pig catcher 80, the flow will also be stopped. At that time flow can be input to ports 160 of cylinders 162 to extend release pins 164 to their inner positions. Custom cylinders 162 and release pins 164 are shown for illustration. Alternately, other devices such as appropriately sized blowout preventer rams can be utilized for this function.

Figure 5:
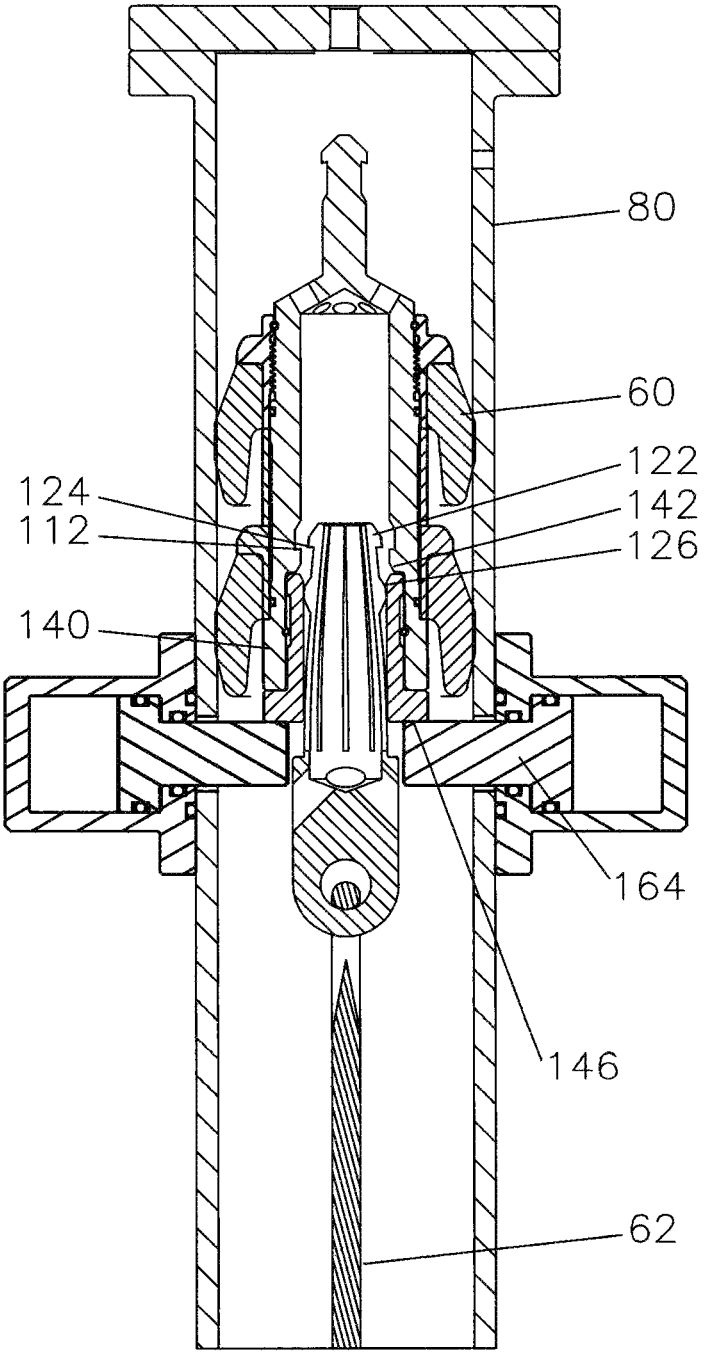
FIG. 5 is a half section of a pig shown in FIG. 4 pulled backwards until a release collet is being released.

Referring now to FIG. 5, at that point tension is increased on restraining line 62 and/or flowline pressure is reduced and cleaning pig 60 starts to move backwards until stop shoulder 146 hits release pins 164. Backwards movement of release sleeve 140 stops while the remainder of cleaning pig 60 continues to travel backwards. Collapsing ring 126 engages release taper 142 collapsing the collapsible collet fingers 122 inwardly releasing locking shoulder 124 from locking groove 112.

Figure 6:
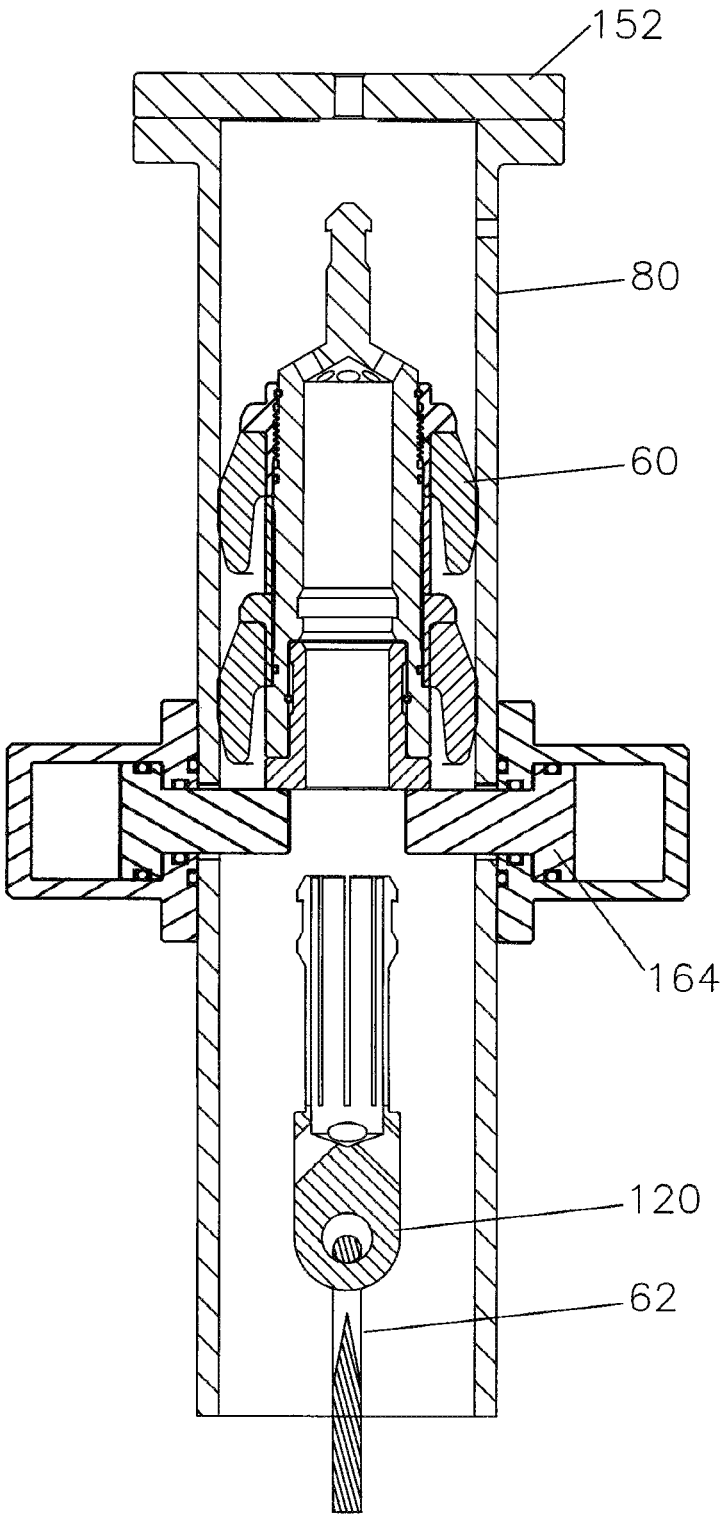
FIG. 6 is a half section of a pig shown in FIG. 4 pulled backwards until the release collet is fully released.

Referring now to FIG. 6, this allows the restraining line 62 with the collet 120 attached to freely move backwards in the pipeline. The collet 120 can be pulled back past valve 72 (see FIG. 1) which can then be closed, and the entire system above valve 72 can be removed. Valve 82 can be closed and the cleaning pig 60 can be removed from the pig catcher 80. During the process, the flow in the pipeline never has to be stopped.

Figure 7:
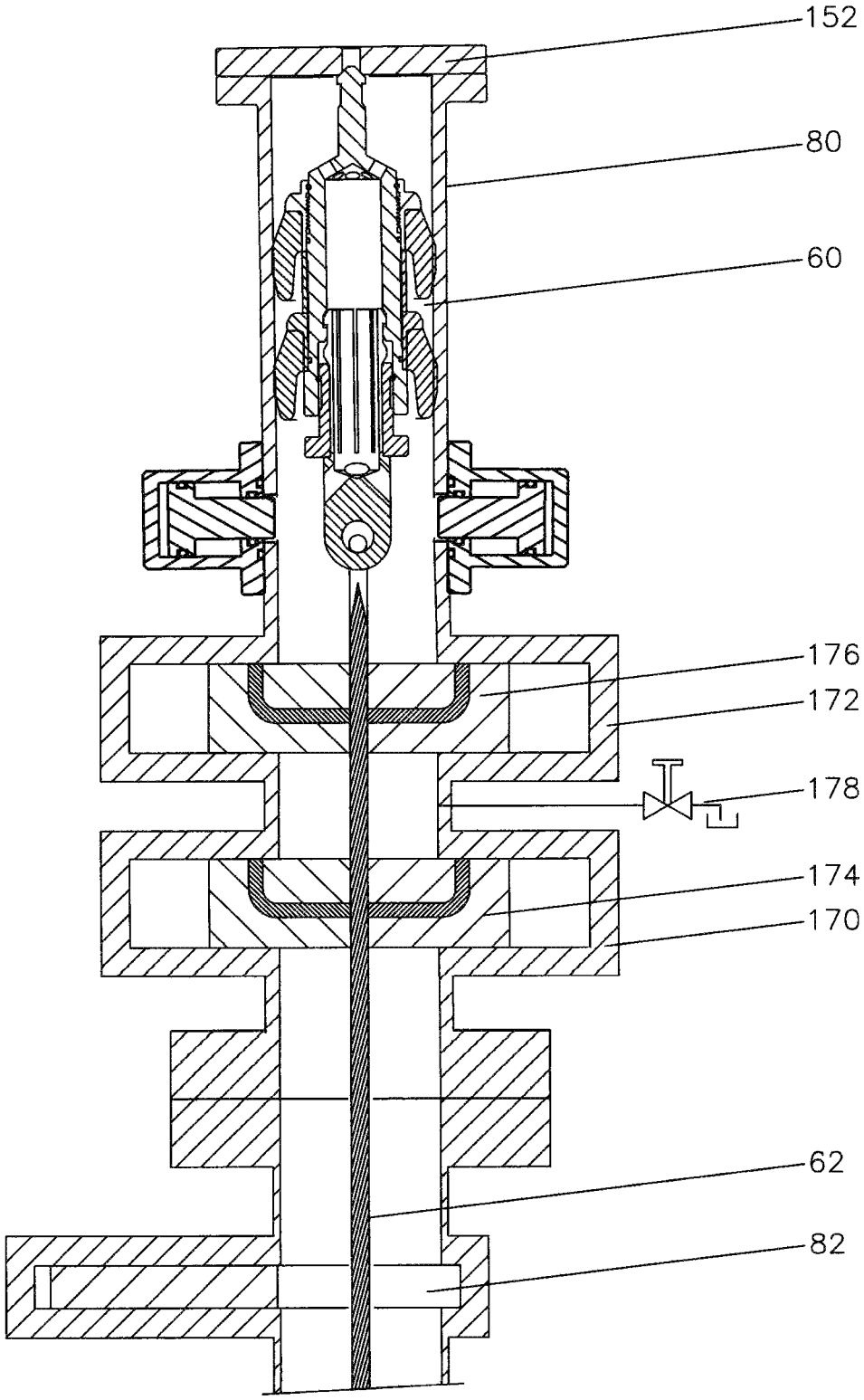
FIG. 7 is a half section of a pig showing blowout preventers closed behind the pig to allow the restraint line to be released at the opposite line and pulled out and would be illustrative of a blowout preventer with shear rams which might simply cut the restraint line.

Referring now to FIG. 7, with the inclusion of blowout preventers 170 and 172 in the assembly with stripping rams 174 and 176 which engage the restraining line 62, the optional method of removing the restraining line on platform 24 also exists. After closing the stripping rams 174 and 176 on the restraining line 62, flange 152 and be removed and the cleaning pig 60 is simply pulled out of the pig catcher 80. If the winch 64 and the storage reel 68 simply release their end of the line, the entire line can be pulled out at platform 24 and delivered back to platform 22 for a future cleaning operation. One reason for two sets of stripping rams is that a complete seal on different styles of restraint lines 62 is not always possible. Some leakage past stripper rams 174 can be taken out vent line 178 for safe processing. With no resulting pressure differential across stripper rams 174, it will be a safe environmental barrier for personnel working above the pig catcher 80.

Additionally, shear or cutter rams can be used in place of the stripper rams 174 or 176 and simply cut the line. The pig 60 can be removed after removing flange 152 and the restraint line 62 can simply be rewound on reel 68.

In these descriptions, platform 24 can be taken to be the equivalent of any onshore or offshore facility which the production might be delivered to.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. system 20 Release sleeve 140 first platform 22 release taper 142 a second platform 24 restraint shoulder 144 ocean surface 26 stop shoulder 146 seafloor 28 port 150 seafloor pipeline 30 flange 152 incoming pipeline 32 port such as 154 export pipeline 34 ports 160 Arrows 40-54 cylinders 162 Cleaning pig 60 release pins 164 restraining line 62 Custom cylinders 162 winch 64 blowout preventers 170 and 172 stripper 66 stripping rams 174 and 176 storage reel 68 vent line 178 arrows 70 shutting valve 72 pig catcher 80 Valve 82 sealing cups 100 and 102 internal surface 104 Cleaning pig body 106 Jetting ports 108 fishing neck 110 internal locking groove 112 restraint pin 114 Collet 120 collapsible collet fingers 122 locking shoulders 124 collapsing ring 126 rear ports 128 padeye hole 130

That which is claimed is:

1. The method of using a flow of liquid or gas in a pipeline to facilitate service operations within said pipeline, comprising connecting to a service pig with a restraining line, deploying said service pig in said pipeline at a deployment location, holding back on said restraining line to cause a pressure differential buildup across said service pig to facilitate said service operations, and releasing said service pig from said restraining line such that said restraining line can be recovered back to said deployment point without bringing said service pig back to said deployment location.

2. The method of claim 1, further comprising directing at least a portion of said flow in said pipeline through flow accelerating means to accelerate a velocity of said liquid or gas and directing said accelerated flow of liquid or gas at the inner wall of said pipeline to clean said inner wall of said pipeline.

3. The method of claim 2, wherein said flow accelerating means is one or more orifices.

4. The method of claim 1, wherein said service pig is an inspection pig and said restraining line assists in controlling steady movement of said inspection pig as it moves along said pipeline to improve the quality of the inspection process.

5. The method of claim 1, further comprising said service pig preventing the flow through a port when said service pig reaches a distal location.

6. The method of claim 1 further comprising said restraining line is a cable, wire rope, synthetic rope, or tubular member.

7. The method of claim 1, further comprising moving releasing stops into said pipeline to effect the release of said service pig when said service pig is pulled backward into said releasing stops.

8. The method of claim 7, wherein said releasing stops are blowout preventer rams.

9. The method of claim 1, further comprising releasing said service pig from said restraining line by cutting said restraining line.

* * * * *